US006735834B2

(12) United States Patent
Fleissner

(10) Patent No.: US 6,735,834 B2
(45) Date of Patent: May 18, 2004

(54) METHOD AND DEVICE FOR COLOR PATTERNING OF A WEB BY HYDRODYNAMIC TREATMENT

(75) Inventor: Gerold Fleissner, Zug (CH)

(73) Assignee: Fleissner GmbH & Co., Maschinenfabrik, Egelsbach (DE)

( * ) Notice: Subject to any disclaimer, the term of this patent is extended or adjusted under 35 U.S.C. 154(b) by 0 days.

(21) Appl. No.: 10/336,015

(22) Filed: Jan. 3, 2003

(65) Prior Publication Data

US 2003/0101557 A1 Jun. 5, 2003

Related U.S. Application Data

(62) Division of application No. 10/167,453, filed on Jun. 13, 2002, now Pat. No. 6,557,224, which is a division of application No. 09/716,281, filed on Nov. 21, 2000, now Pat. No. 6,487,762.

(30) Foreign Application Priority Data

Nov. 24, 1999 (DE) ..... 199 56 571

(51) Int. Cl.[7] ..... D04H 13/00; D06C 23/00
(52) U.S. Cl. ..... 28/104; 28/163; 28/167
(58) Field of Search ..... 28/104, 105, 106, 28/167, 163, 103, 109; 26/69 R

(56) References Cited

U.S. PATENT DOCUMENTS

| | | | | | |
|---|---|---|---|---|---|
| 2,730,933 | A | | 1/1956 | Reynolds | |
| 2,970,365 | A | | 2/1961 | Morgenstern | |
| 3,034,180 | A | * | 5/1962 | Greiner et al. | 19/301 |
| 3,042,576 | A | | 7/1962 | Harmon | |
| 3,214,819 | A | | 11/1965 | Guerin | |
| 3,485,706 | A | * | 12/1969 | Evans | 28/105 |
| 3,486,168 | A | * | 12/1969 | Evans et al. | 28/105 |
| 3,506,530 | A | | 4/1970 | Crosby | |
| 3,508,308 | A | * | 4/1970 | Bunting, Jr. et al. | 28/104 |
| 3,705,064 | A | | 12/1972 | Lochner | |
| 3,725,166 | A | | 4/1973 | McCord | |
| 3,750,237 | A | * | 8/1973 | Kalwaites | 28/105 |
| 3,768,121 | A | | 10/1973 | Kalawaites | |
| 3,819,465 | A | | 6/1974 | Parsons | |
| 4,144,366 | A | | 3/1979 | Lewis | |
| 4,146,663 | A | | 3/1979 | Ikeda | |
| 4,211,593 | A | | 7/1980 | Lochner | |
| 4,297,404 | A | | 10/1981 | Nguyen | |
| 4,519,804 | A | | 5/1985 | Kato | |
| 4,691,417 | A | | 9/1987 | Vuillaume | |
| 4,948,649 | A | | 8/1990 | Hiers | |
| 4,995,151 | A | * | 2/1991 | Siegel et al. | 26/69 R |
| 5,115,544 | A | * | 5/1992 | Widen | 28/105 |
| 5,153,056 | A | | 10/1992 | Groshens | |
| 5,175,042 | A | | 12/1992 | Chomarat | |
| 5,274,893 | A | * | 1/1994 | Kitamura et al. | 28/105 |
| 5,405,650 | A | | 4/1995 | Boulanger | |
| 5,632,072 | A | | 5/1997 | Simon | |
| 5,674,587 | A | * | 10/1997 | James et al. | 428/131 |
| 5,737,813 | A | | 4/1998 | Sternileb | |
| 5,761,778 | A | | 6/1998 | Fleissne | |
| 5,768,756 | A | | 6/1998 | Noelle | |
| 6,460,233 | B2 | * | 10/2002 | Noelle | 28/104 |

* cited by examiner

*Primary Examiner*—Amy B. Vanatta
(74) *Attorney, Agent, or Firm*—Antonelli, Terry, Stout & Kraus, LLP

(57) ABSTRACT

Colored patterning of a web-shaped nonwoven or a composite made of a nonwoven and a fabric or knit is achieved by water jet needling. The nonwoven provided as the upper layer of two layers is provided with one or more colors or is colored or printed itself and is placed on a second nonwoven or a woven or one that has a different color. Then both layers are subjected to the water jets that displace the fibers, with the colored fibers in the first layer being displaced into the second layer to produce a pattern on the underside of the second layer. It is also possible, instead of colored fibers in the nonwoven of the upper layer, to move them when they are not colored into a second layer that can have any color.

6 Claims, 1 Drawing Sheet

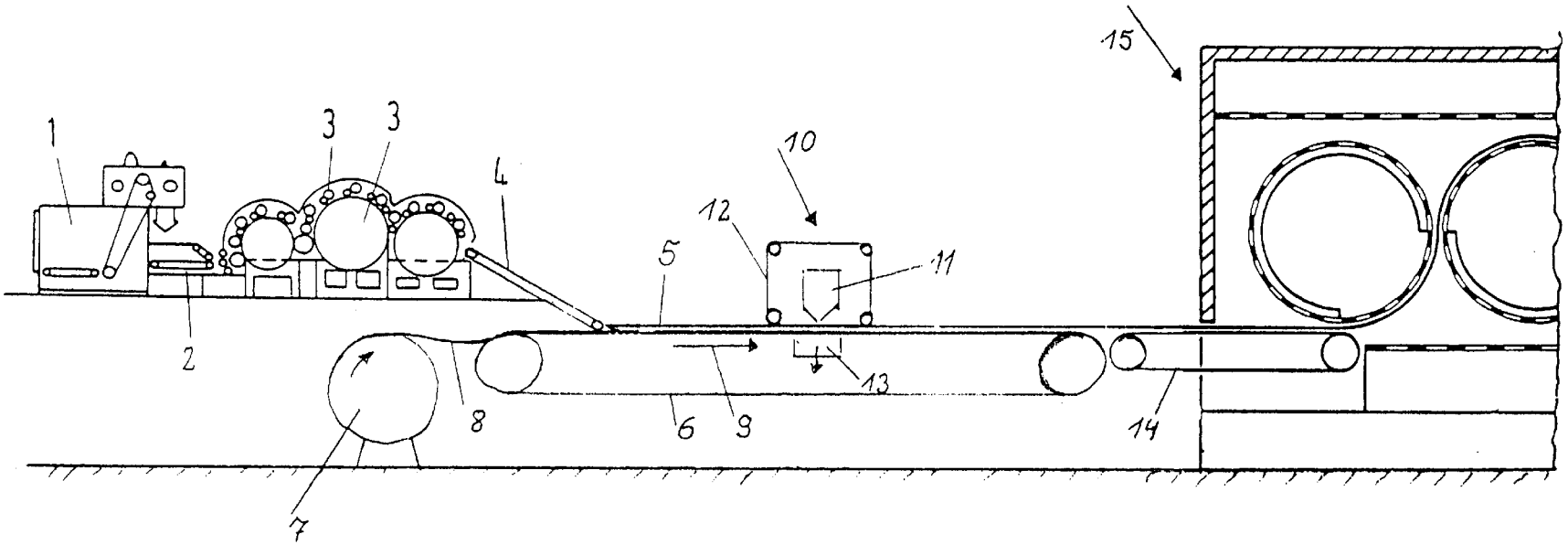
1
2
3
3
4
5
6
7
8
9
10
11
12
13
14
15

METHOD AND DEVICE FOR COLOR PATTERNING OF A WEB BY HYDRODYNAMIC TREATMENT

This application is a divisional application of U.S. Ser. No. 10/167,453, filed Jun. 13, 2002, now U.S. Pat. No. 6,487,762 which is a divisional application of U.S. Ser. No. 09/716,281, filed Nov. 21, 2000.

BACKGROUND OF THE INVENTION

The invention relates to a method for colored patterning of a web-shaped nonwoven or a composite of a nonwoven and a fabric or knit by means of hydrodynamic needling, with the web lying on a substrate and moving-past a nozzle beam arranged crosswise to the transport direction and impacted by the water jets.

A method of this kind is known from WO 89/09850. According to this document, a colored web is guided over a plane provided with a three-dimensional pattern and impacted by water jets to produce a washed-out effect on the initially off-color inking.

A pattern without inking is possible using hydrodynamic treatment when, according to U.S. Pat. No. 4,691,417 or EP-A-0 400 349, the water jets are directed at the web of goods such as a nonwoven through a sheet with a perforated pattern. The water jets, as viewed over their area, impact the fibers of the web of goods only partially and displace it only there to form a pattern similar to a watermark.

DISCLOSURE OF THE INVENTION

The goal of the invention is to find a method for achieving a colored patterning of a web of goods, in which a pattern results from hydrodynamic treatment which has the desired colors and pattern types and sizes, without having to be alert for washing-out effects.

Taking its departure from the method of the type mentioned at the outset, the invention provides as a solution to the stated goal that a nonwoven provided with one or more colors or dyed or printed is chosen as the upper layer of two layers, and this nonwoven is placed on a second nonwoven or woven or one having a different color and both layers are subjected to the water jets which displace the fibers. The colored fibers of the first layer are displaced into the second layer to produce a pattern on the underside of the second layer.

The nonwoven in the first layer can come directly in front of a card and has fine fibers of one or different colors. When these fibers are subjected to the water jets, they are moved into and through the second layer. Hence, not only the known solidification of the webs alone and with one another takes place but the fibers of the first nonwoven reach the underside of the second web of goods and produce a pattern of some type there because of their own color. This pattern can be influenced in a wide variety of different ways.

A color pattern according to the invention can also be produced by the second web being produced with dyed fibers for example instead of the dyed fibers of the first nonwoven and then for example white fibers in the first nonwoven penetrate to the back of the colored second nonwoven by the water needling and there they produce a pattern of some type on the underside. This pattern can be influenced in a wide variety of different ways as well.

To produce a pattern on the back of the second web of goods with the fibers of the first nonwoven, it is important for these fibers to be readily movable by the water jets, in other words for them to have a fine titer such as 1-6 dtex in diameter and a finite length of 20 to 100 mm. In any case, the first nonwoven is non-solidified and is a light card nonwoven. The second web, on the other hand, can also be a nonwoven but it can be pre-solidified by mechanical needling for example or it can be a weave or a knit that forces a definable direction of the fibers penetrating from the first nonwoven by its internal thread structure. This is typical of the pattern that can be produced on the underside. It is also important in this regard, from what fibers the second web is produced. Their thickness, properties, and the strength of the thread structure of the second web are important.

Quite different color patterns can be produced if a third means for steering the water jets in a desired direction is added. This means can be located in front of or between the two layers or even below the second web. If the element is located between the webs, it is obvious that it remains permanently in the total product. It is different if for example the water jets are aimed at the first nonwoven by an endless belt or drum that is permeable with a pattern that unrolls directly on the nonwoven. The partially colored fibers of the first nonwoven are partially transported through the second web so that it is only at these places that coloration of the back of the second web or patterning takes place.

BRIEF DESCRIPTION OF THE DRAWING

A device for working the method according to the invention is shown as an example in the drawing. It consists only of the details in the device that are known of themselves. The FIGURE shows a continuous system for making a patterned nonwoven with final drying.

DETAILED DESCRIPTION OF THE PREFERRED EMBODIMENT

First, the lightweight nonwoven on top is made of polyester fibers and/or polypropylene fibers and/or natural fibers. A card 1-4 is used as the nonwoven laying device. The card consists of a weighing hopper 1 with a vibrating slide 2 located beneath which transfers the fibers of the card spread out uniformly over the width with the scratching and toothed rollers 3. The following endless belt 4 transfers the loosely formed nonwoven 5 to endless belt 6. The latter already carries a nonwoven or fabric or knit pulled off roller 7 and marked 8 which moves together with the endless belt 6 in the direction of arrow 9 to needling station 10.

Needling station 10 receives a composite of two superimposed webs 5 and 8. In order to be able to produce a color pattern on the underside of web 8 by the water jets of beam 11, either nonwoven 5 consists of colored fibers and/or web 8 is made of colored fibers, but of a different color. The web can be white or colored and the colors in webs 5 or 8 are selected accordingly. The first web in any case is a nonwoven 5; the second web 8 can also be one but it can also be a fabric or knit.

The fibers of the nonwoven are moved through second web 8 by the water jets of beam 11 which must impact nonwoven 5 with greater energy (more than 200 and preferably 350 bars for example) with the fibers of the nonwoven being moved through the second web 8 to its rear side lying on belt 6. Depending on the structure of web 8 or endless belt 6 or the steering of the water jets above web 8 or web 5, a different color pattern is produced on the back of web 8. The design of the pattern can be influenced especially well if an element is used for the purpose that steers the water jets. This can be the endless belt 12 shown, a correspondingly located drum, the shape of endless belt 6, or a layer that remains within the composite. Endless belt 12 or the corresponding drum can be a braided fabric or be made of a sheet perforated with a desired pattern. It is only at the holes in endless belt 12 that are open to allow the water to pass through or in the drum that the fibers of nonwoven 5 can move into web 8. Consequently, it is only at these places on the back of web 8 that the fiber composition can change that produces the desired pattern.

After dewatering by suction 13 which can also be performed downstream from needling station 10, the web is guided through endless belt 14 into screen drum dryer 15.

What is claimed is:

1. A device for colored patterning of a web of a nonwoven or a composite of a nonwoven and a fabric or knit, by subjecting the web including a first layer and a second layer to water jets to displace fibers so that fibers of the first layer are displaced into the second layer to produce a colored pattern on an underside of the second layer, the device comprising:

a feeder for feeding the second layer;

a device for providing the first layer on the second layer to form the web;

an endless belt for transporting the web in a transport direction; and a nozzle beam provided adjacent the endless belt and arranged crosswise to the endless belt for directing water jets to the web;

wherein the endless belt includes a perforated pattern to direct the water jets from the nozzle beam through the web to displace fibers of the first layer into the second layer to produce the desired color pattern;

wherein the device for providing the first layer on the second layer provides a first layer of a color different than that of the second layer.

2. The device according to claim 1, further comprising a suction device provided on a side of a portion of the endless belt opposite the nozzle beam.

3. The device according to claim 1, wherein the feeder for feeding the second layer feeds the second layer to the endless belt, and wherein the device for providing the first layer on the second layer is a card for laying the first layer and placing the first layer on the second layer, the device further comprising a suction device provided on a side of a portion of the endless belt opposite the nozzle beam, and a drying device for drying the web having the desired color pattern.

4. The device according to claim 1, wherein the feeder for feeding the second layer comprises a roller for feeding a fabric or knit material as the second layer.

5. The device according to claim 4, wherein the device for providing the first layer on the second layer provides a nonwoven layer as the first layer.

6. The device according to claim 5, wherein the device for providing the first layer on the second layer is a card for laying the nonwoven layer as the first layer on the second layer.

* * * * *